US009568028B2

(12) United States Patent
Nowak et al.

(10) Patent No.: US 9,568,028 B2
(45) Date of Patent: Feb. 14, 2017

(54) TELESCOPIC ACTUATOR

(75) Inventors: Wieslaw Nowak, Krosno (PL); Zygmunt Nowak, Krosno (PL); Janusz Nowak, Krosno (PL)

(73) Assignee: NOWAK INNOVATIONS SP. Z O.O., Krosno (PL)

( * ) Notice: Subject to any disclaimer, the term of this patent is extended or adjusted under 35 U.S.C. 154(b) by 652 days.

(21) Appl. No.: 13/817,994

(22) PCT Filed: Aug. 18, 2011

(86) PCT No.: PCT/PL2011/000088
§ 371 (c)(1),
(2), (4) Date: Feb. 20, 2013

(87) PCT Pub. No.: WO2012/023868
PCT Pub. Date: Feb. 23, 2012

(65) Prior Publication Data

US 2013/0139681 A1 Jun. 6, 2013

(30) Foreign Application Priority Data

Aug. 20, 2010 (PL) ..... 392187

(51) Int. Cl.
*F15B 15/16* (2006.01)
*F15B 15/20* (2006.01)

(52) U.S. Cl.
CPC ..... *F15B 15/20* (2013.01); *F15B 15/16* (2013.01)

(58) Field of Classification Search
CPC ..... F15B 15/20; F15B 15/16; F15B 15/18; F15B 15/19
USPC ..... 91/169, 1, 5; 92/51, 52, 53; 280/753
See application file for complete search history.

(56) References Cited

U.S. PATENT DOCUMENTS

| | | | | |
|---|---|---|---|---|
| 2,457,467 | A * | 12/1948 | Hartman | 60/475 |
| 5,341,724 | A * | 8/1994 | Vatel | 92/53 |
| 5,400,695 | A * | 3/1995 | Walker | 92/128 |
| 5,934,175 | A * | 8/1999 | Vatel | 92/252 |
| 6,536,708 | B1 | 3/2003 | Rheinhard | |
| 6,543,223 | B2 * | 4/2003 | Muschong et al. | 60/476 |
| 7,357,415 | B2 * | 4/2008 | Enders | B60R 21/02 280/753 |

(Continued)

FOREIGN PATENT DOCUMENTS

| | | |
|---|---|---|
| DE | 1240434 | 5/1967 |
| GB | 2395693 A | 6/2004 |

(Continued)

*Primary Examiner* — Michael Leslie
*Assistant Examiner* — Dustin T Nguyen
(74) *Attorney, Agent, or Firm* — Horst M. Kasper

(57) ABSTRACT

The subject matter of this invention is a telescopic actuator with tubular cylinders which at the same time function as pistons, used to move/shift/translocate pieces of devices especially while emergency opening damaged movable elements/components. It has a bushing body (1) connected with a head (5) attached to its free end and the head has a control segment (10) and the systems feeding the actuator with pressure agent/factor, created in the form of at least one gas generator (9); and by the fact that the bushing/sleeve body (1), the first cylindrical piston (2) and another cylindrical piston (3) have at least one ring groove situated on the surface mating with another tubular element near the head faces of those tubular elements.

20 Claims, 8 Drawing Sheets

(56) References Cited

U.S. PATENT DOCUMENTS

2009/0217814 A1* 9/2009 Dreyer ..... B60R 21/34
92/18

FOREIGN PATENT DOCUMENTS

| | | | |
|---|---|---|---|
| PL | 165 933 | B1 | 3/1995 |
| PL | 188 431 | B1 | 1/2005 |
| PL | 194 447 | B1 | 6/2007 |

* cited by examiner

TELESCOPIC ACTUATOR

The subject matter of this invention is a telescopic actuator with tubular cylinders which also function as pistons, used to move/shift/transfer pieces of devices especially while emergency opening damaged movable elements/components.

Hydraulic telescopic actuators are known, composed of several cylinders of relatively short length of a collapsed actuator. There is also a bi-telescopic actuator composed of a cylinder in which an external piston rod is installed with an internal piston rod installed in the external piston rod. One end of the cylinder is closed with a bottom and both piston rods protrude out of the other end, while the space between the cylinder and the outer piston rod, called the side over-piston space, is closed with a choking bushing, and the space between the outer and inner piston rod, called middle over-piston space, is closed with a gland/packing. Both piston rods are moved both ways under the pressure of a working agent supplied to the inside of the actuator, but the moving-out action of both piston rods is effected after the sub-piston spaces are fed with an agent flowing through a connection and a small groove, which are placed in the cylinder close to its bottom.

There is also a bi-telescopic actuator known from the Polish patent description 165933, which has a cylinder with two telescopic piston rods activated/moved by the pressure of a working agent introduced inside the actuator through lines fitted to connections linked through grooves with the inner spaces, feeding the over-piston spaces of this actuator.

Another hydraulic telescopic lift (jack), known from the Polish patent description of invention number 188431, features an inlet of hydraulic fluid, a base, a corrosion-resistant outer tube with its one end installed on the base along with a gasket between them and the other end open, with at least one intermediary corrosion-resistant tube placed in the outer tube in telescopic position, whereas the intermediary tube has inner and outer ends and it is moved out from the open end of the outer tube to a protruded (moved-out) position and it is moved into through the open end of this tube to collapsed position. Besides, this lift has got hydraulic sealing fitted around the bottom end of the intermediary tube and constituting the sealing between the intermediary tube and the outer tube, and also it has a bearing with a gland nut fitted to the open end of the outer tube, intended to retain the position of the inner end of the intermediary tube relative to the outer tube. The point of this telescopic lift is that there is some air space between the intermediary tube and the outer tube, and the outer tube has a relief air valve installed in it, which is connected with the air space. Patent description 51071 presents an actuator of varied spacing of leading bushings which are located near one end of the piston rods. The ends of the actuator's tubes located at the pressure input are open, to let the feeding pressure pass through, and they have only limit ring restricting the stroke/travel of the actuator's cylinders/piston rods.

The Polish patent description 194447 demonstrates a small-size actuator for emergency opening of vehicle doors, using pyrotechnic charges, whose cylinders are vented (emptied) by a solenoid valve.

The basic disadvantage of the known configurations of pneumatic and hydraulic actuators is the fact that they are composed of a relatively large number of parts which require machining, i.e. turning, milling, grinding, polishing, honing etc. Furthermore, the pistons fitted in cylinders, as it is difficult to obtain high precision of the nominal dimensions of the cylinders' diameters, do not assure required tightness, especially when the pistons are activated (moved) by a gaseous agent or by another agent of high working pressure.

Besides, the telescopic lift, known from the patent description: U.S. Pat. No. 4,471,944, has got a number of coaxial tubular telescopic elements installed in the cylinder, and each pair of adjacent tubular telescopic elements has two pairs of co-working ring-shaped hollows on their outer and inner surfaces, which cooperate with a resilient ring in order to restrict the movement of the inner tubular element to the outside relative to the neighboring/adjacent outer element. In this embodiment the lateral surfaces are guides for the sliding-out elements and the resilient rings are placed in small grooves which, during the lift operation, are compressed and expanded and at the same time they move out and into the small grooves.

This embodiment's drawback is the necessity to machine the ring grooves with high precision and if this condition is not met, the resilient ring stroke may be blocked and the telescopic element may be moved out of the cylinder and, furthermore, low precision results in the faster wear out of both grooves and rings. Apart from that, this embodiment may result in getting stuck, soiling or fracture of the resilient ring, which, in turn, may result in unsafe operation of the actuator as the ring does not move out.

The purpose of this invention is to develop a telescopic actuator embodiment of a much simpler and compact and more reliable configuration, reducing substantially the machining operations on its parts and providing reliability of function, especially when the actuator is activated by means of a gaseous agent. The coaxially installed cylindrical pistons are fitted with sealing-guiding-and-stopping rings on both ends of the cylindrical pistons. The closure of both ends of the cylindrical pistons forms a shock-absorbing/buffering cushion of the air trapped in the small ring spaces between the cylindrical pistons and it supports the stroke stops at the end of the move-out motion. Besides, the closed space gives a possibility to introduce lubricants and sliding agents.

The purpose of the invention has been achieved in a telescopic actuator composed of a bushing body/housing and cylindrical pistons of diminishing diameters installed inside the housing and inside one another, and sequentially moving out as a result of the pressure agent action, the actuator having the tubular body connected with a head, attached to one of its ends and having a control segment and the systems feeding the pressure agent to the actuator, the systems consisting of at least one gas generator. The bushing body and the first cylindrical piston and another cylindrical piston have at least one ring groove located on the surface mating another tubular element, close to the end faces of those tubular elements. At least one ring or at least one ring-assembly composed of at least two rings is placed in this groove/those grooves, and the rings/ring-assemblies function as guides and sealing of those tubular elements, the function being performed by the ring/rings circumference and the stop function is performed by the end faces of the ring/rings, and the functions can be divided among/shared by particular rings or ring-assemblies following one after another, or they may be integrated in a single ring. The function of sealing and guiding is performed as a result of mating of the particular rings or the ring-assemblies with the tubular elements of the body, the first tubular piston and the second tubular piston, as cylindrical tubes of high dimensional precision and cylindrical-shape precision of their outer and inner diameters and low surface roughness.

The telescopic actuator has a control segment and at least one gas generator which are installed in the head in graduated holes in a plate fitted in the head and they are secured by a pressing stop-plate with a securing ring. The electric leads necessary for their function are led out through a side opening in the head wall, while two-stage head stopper/plug constitutes the first stop/resistance surface of the actuator.

The control segment of the actuator is a detector sensing at least pressure, travel distance or pressure and travel distance of the actuator and transferring the signal, controlling the means which change the pressure magnitude in the actuator, to the actuating elements. The telescopic actuator has a support bushing installed on the outer wall of the tubular body/housing. The other stop/resistance surface of the actuator is a pressing element with a cylindrical retaining protrusion and a sealing ring, mating the outer surface of the actuator's tubular body/housing, in the status of moved-out (protruded) cylinders of the actuator. With pre-determined dimensional parameters of tubes, the sliding parameters of the actuator are determined by the sizes of the ring grooves and by the shape or the set of the rings placed in them.

The simplified, shorter variety of the actuator has one cylindrical piston sliding inside the bushing-shaped/tubular body/housing.

The construction/configuration embodiment of the telescopic actuator as per the invention reduces to a minimum the number of parts and components. The functions of simultaneous guiding, sealing, limitation/stopping of stroke/travel and the shock-absorbing cushion of the air trapped in the ring spaces between the cylinders are performed by the rings or the ring assemblies. They are situated on both ends of the cylindrical pistons in the grooves on the precision tubular surfaces. Their functions may be distributed among particular rings or the ring assemblies (they may be shared by the particular rings or ring assemblies). The control segment of the actuator provides immediate response to the position of the actuator's cylinders by sending a signal to actuating systems.

The subject matter of the invention has been visualized in the examples, as it was made, in the drawings attached where FIG. 1 shows the telescopic actuator with single rings in axial section;

Figure 1:
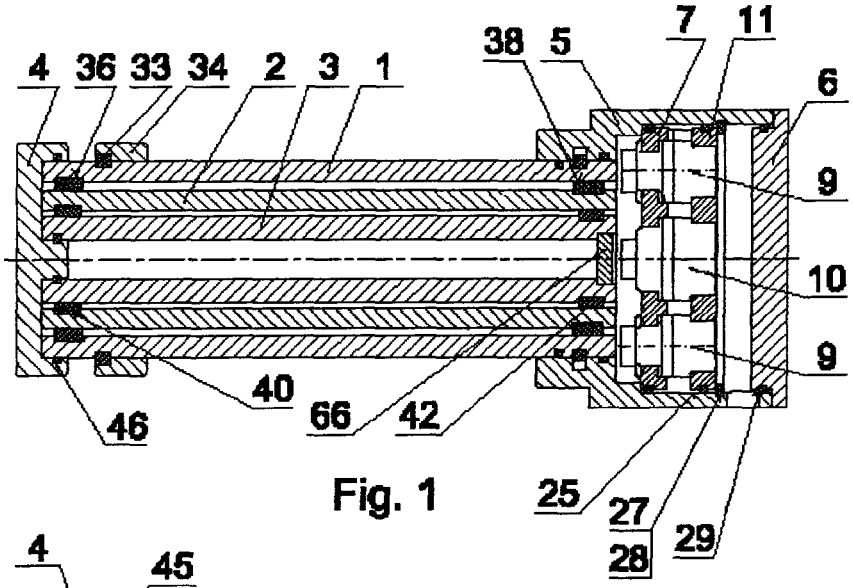
Figure 2:
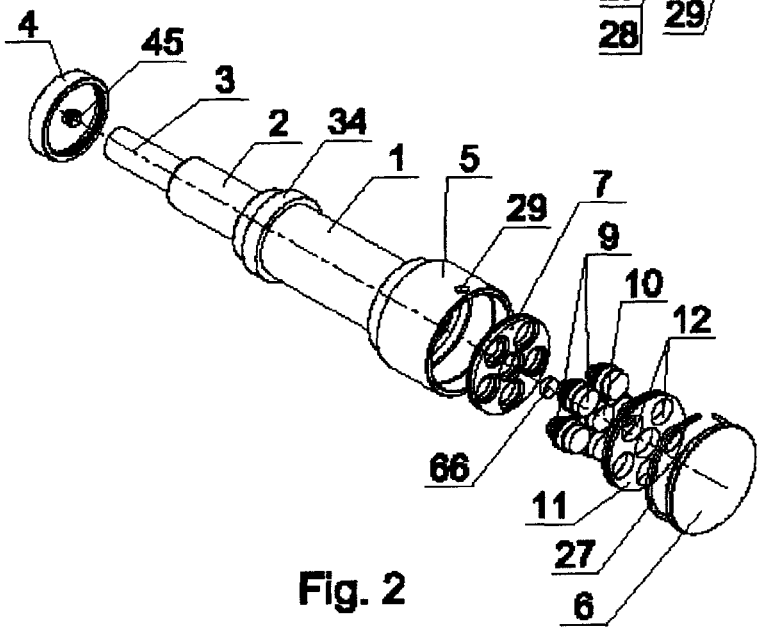
FIG. 2 shows the actuator expanded in perspective view.
Figure 3:
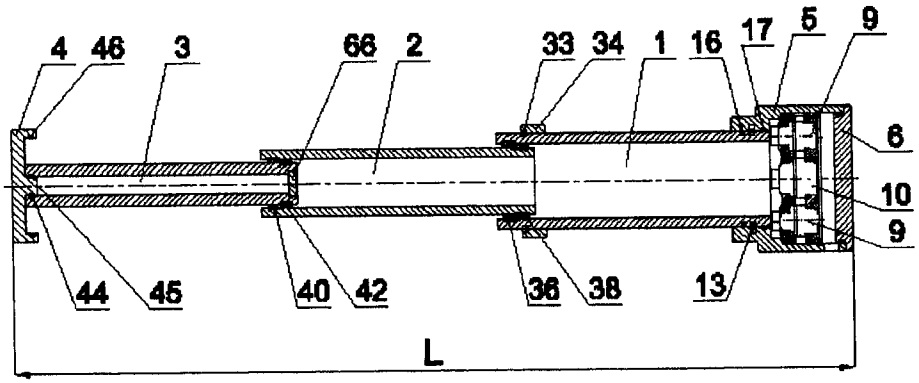
FIG. 3 shows the actuator with its pistons moved out from its cylindrical body/housing to the maximum length (travel) "L", in the axial section.
Figure 4:
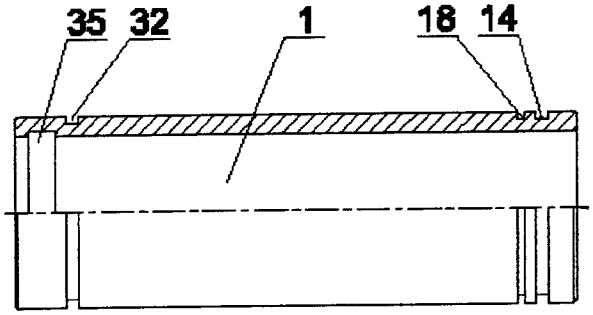
FIG. 4 shows the body/housing of the actuator with the ring grooves, in the axial half section—half view.
Figure 5:
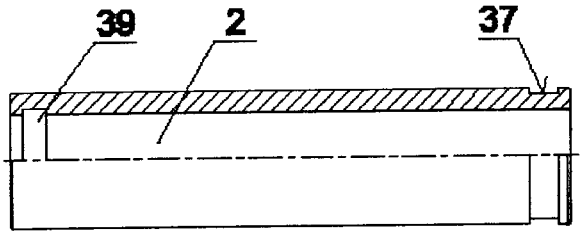
FIG. 5 shows the cylindrical piston of this actuator with its ring grooves, in the axial half section—half view.
Figure 6:
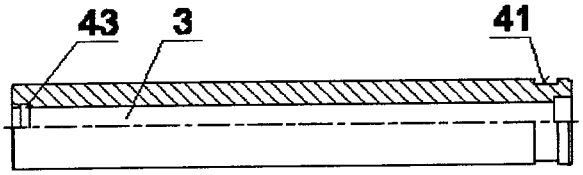
FIG. 6 shows the second cylindrical piston with its ring grooves, in the axial half section—half view.
Figure 7:
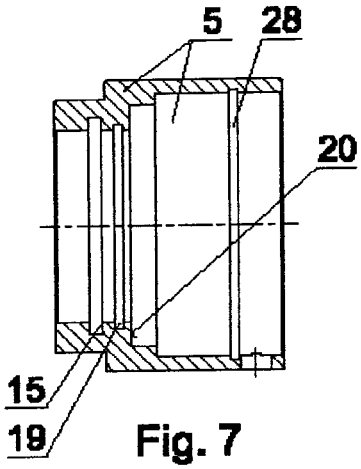
FIG. 7 shows the actuator head in the axial section.
Figure 8:
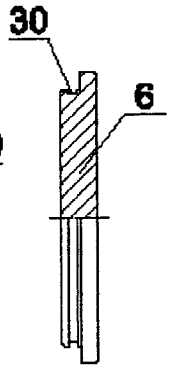
FIG. 8 shows the actuator's head plug in the axial section.
Figure 9:
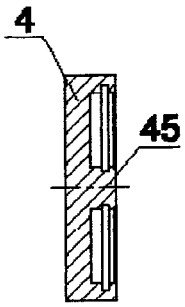
FIG. 9 shows the separable pressing element covering one end face of the actuator in the axial section.
Figure 10:
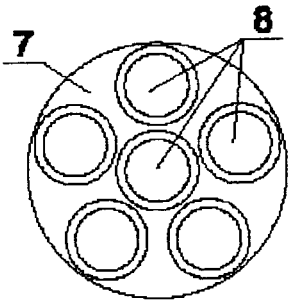
FIG. 10 shows the front view of the gas generators' plate.
Figure 11:
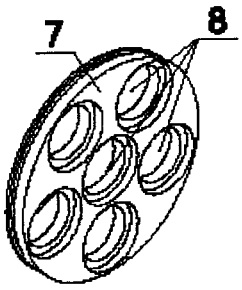
FIG. 11 shows the same plate in a perspective view.
Figure 12:
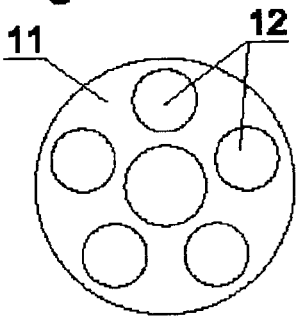
FIG. 12 shows the front view of the pressing/retaining plate of the gas generator.
Figure 13:
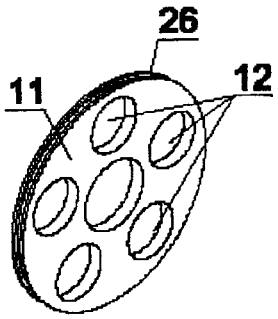
FIG. 13 shows the same pressing/retaining plate in a perspective view.

The telescopic actuator in the first example of configuration, presented in FIGS. 1-13 is made up of a bushing/tubular body/housing (1), two cylindrical pistons (2 and 3) coaxially installed in it, fitted together one in the other and installed on this body/housing and inside the second cylinder (3), pressing element (4) covering one end face of both cylindrical pistons (2 and 3) and a bushing/tubular body/housing (1), on the other end of which the head (5) is fitted, the outer end face of which is covered by a plug (6), and a round plate (7) is fitted in the head (5), with the gas generators (9) fixed in the graduated openings (8) in the plate, and the pressure controller (10) installed between them, and/or the routes of travel/stroke; the gas generators and the sensor are pressed/retained with a retaining plate (11) featuring round openings (12). The actuator's head (5) is installed on the outer surface of the rear end of the bushing/tubular body/housing (1) with a securing/protecting ring (13), installed in the ring grooves (14 and 15) located opposite each other, made respectively on the inner surface of the head (5) and on the outer surface of the bushing/tubular body/housing (1), and there are two sealing rings (16 and 17) located on both sides of the protective ring (13), and the ring (16) is placed in the ring groove (18) made on the outer surface of this body and ring (17) is placed in the ring groove (19) made-on the outer surface of the head (5). A plate (7) with a sealing ring and the gas generator(s) (9) installed in it is adjacent to the ring-shaped inner end face (20) of the head (5) and with a controller (10) sensing the pressure and/or the actuator travel (distance); the generators also have the sealing rings, and a sealing ring (25), inserted in its ring groove (26). is placed on the plate (11) retaining (pressing) the generators and the sensor, and the plate's outer end face is pressed with a securing ring (27) inserted in the ring groove (28) of this head with a two-stage plug (6) installed inside the head (5) and adjacent to its end face, and a sealing ring (29), inserted in the ring groove (30) on the plug, is placed between the inner surface of the head and the outer surface of the plug (6).

The plug, at the same time, constitutes the first resistance surface of the actuator. Further, the front end of the bushing body (1) has a ring groove (32) on the body's outer surface, and there is a stop/resistance ring (33), placed in the groove, and a stop/resistance bushing (34) installed on the body is set against the ring (33); and the ring also functions as a supporting element of the actuator, and on the inner surface of the body (1), near its end face, it has a ring groove (35) with one ring (36) inserted in it.

In turn, the first cylindrical piston (2) installed coaxially in the sleeve body (1) has got—on its outer surface close to its rear end face, on the side of the gas generators (9)—a ring groove (37) with one ring (38) inserted in it, and on the piston's inner surface, near the piston's front end face, the piston (2) has a ring groove (39) with one ring (40) inserted in it. Another cylindrical piston (3), of smaller diameter, installed coaxially within the cylindrical piston (2), has—on its outer surface and near its rear end face—a ring groove (41) with a ring (42) inserted in it, and on the second piston's inner surface, near its front end face, there is a ring groove (43) with a ring (44) inserted in it, and a cylindrical protrusion (45)—installed inside the cylindrical piston—of a pressing element (4) set on the front end face of the bushing body (1), with an adjacent/mating sealing ring (46), in the collapsed (folded, not-expanded) position of the actuator's cylindrical pistons. The mating rings (36 and 38) as well as (40 and 42) of the cylindrical pistons (2 and 3) of the actuator have properly selected thicknesses and when the actuator's both cylindrical pistons (2 and 3) are in an expanded (moved out) position to the maximum length "L" from the actuator's bushing body (1), the neighboring faces of these rings pairs mate with a pressure (with a resistance/with a stop).

Figure 14:
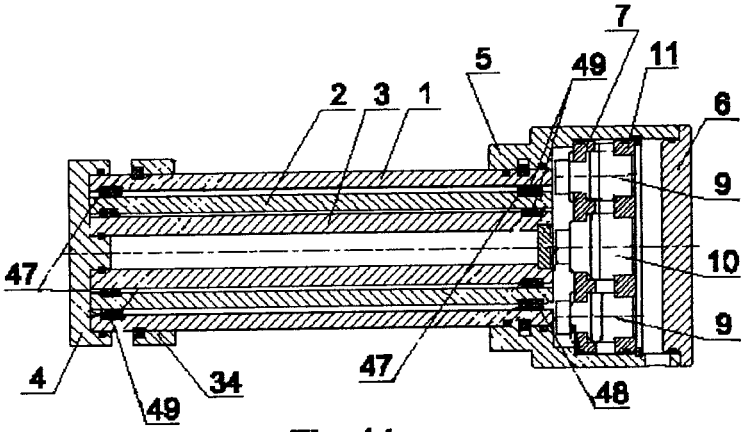
FIG. 14 shows another option of producing the telescopic actuator with the ring assemblies in one groove, in the axial section.

The telescopic actuator as per the second example of its embodiment is shown in FIG. 14, but in the ring groove (35) of the bushing body and in the ring grooves (37), (39) and (41) of the cylindrical pistons (2 and 3) the ring sets/assemblies (47, 48) and (49) are inserted.

Figure 15:
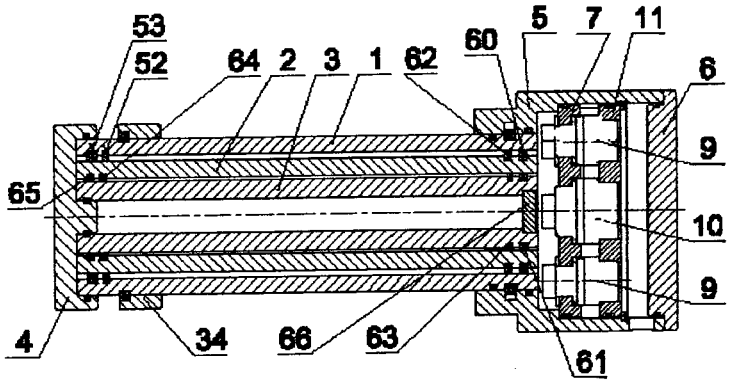
FIG. 15 shows the third variant of the telescopic actuator configuration with single rings in separate grooves, in the axial section.
Figure 16:
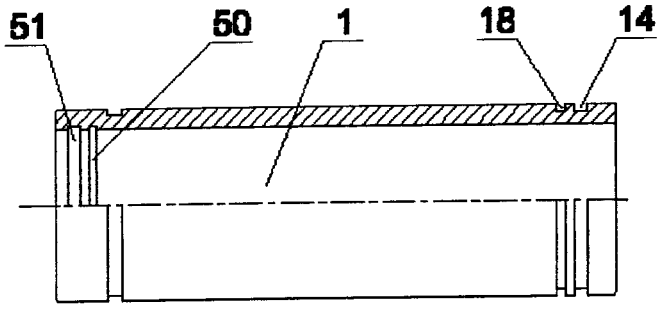
FIG. 16 shows the cylindrical body/housing with two grooves, in the half section half view.
Figure 17:
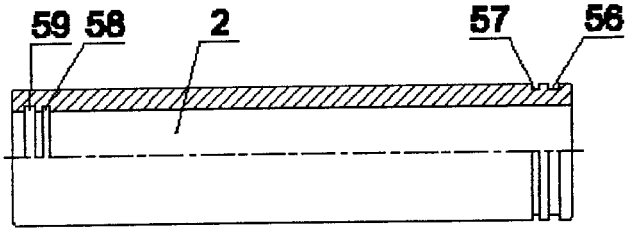
FIG. 17 shows the first cylindrical piston of the third variant of the actuator, in the half section—half view.
Figure 18:
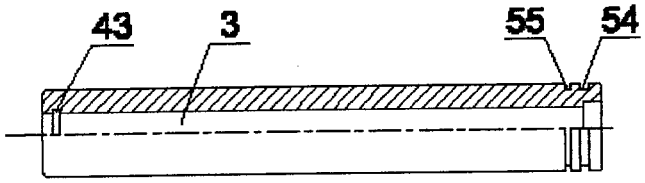
FIG. 18 shows the second cylindrical piston of the third variant of the actuator, in the half section—half view.
Figure 19:
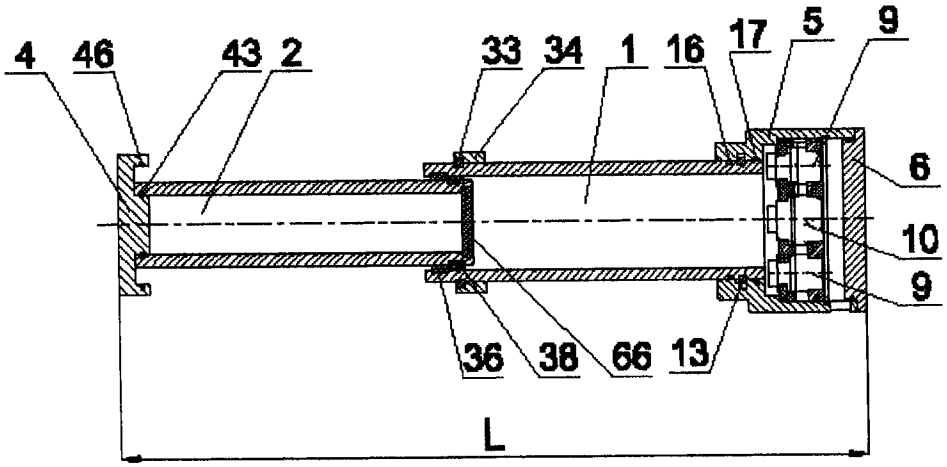
FIG. 19 shows the fourth variant of the telescopic actuator's configuration with one cylindrical piston only, in the axial section.
Figure 20:
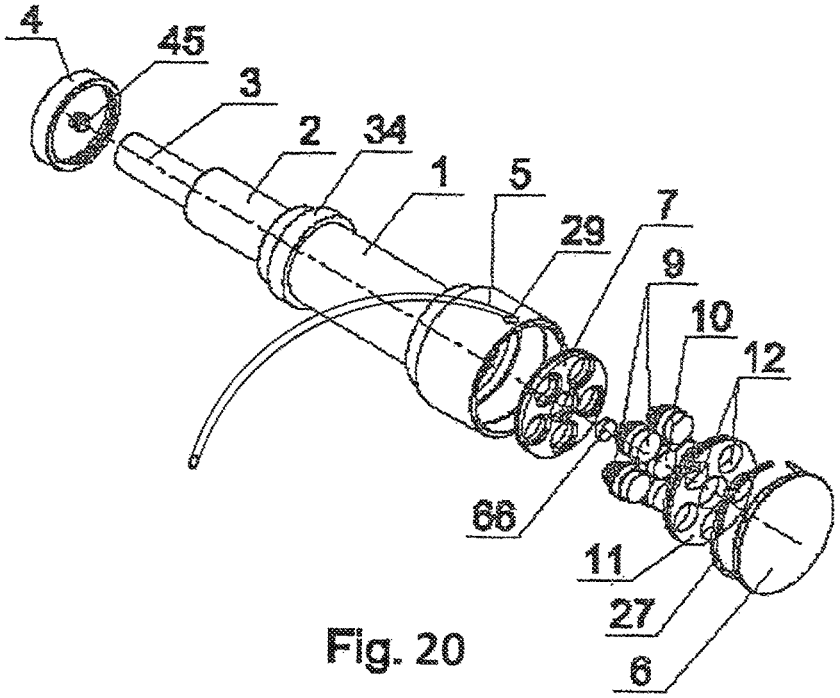
FIG. 20 shows the front view of the pressing/retaining plate of the gas generator with the electric wire.

In turn, the telescopic actuator as per the third example of its embodiment, shown in FIG. 15, is also made up of the same elements as the actuator as per the first example of its embodiment, shown in FIG. 2 and FIGS. 4-13, but the bushing body (1) has two ring grooves (50) and (51), located one next to the other, on its inner surface, near its front end face, with the rings (52), (53) located individually in the grooves. Besides, the bushing pistons (2 and 3)—on their both ends, near their end faces, on their inner and outer surfaces—also have two pairs of grooves (54 and 55), (56 and 57), as well as (58 and 59), located one next to the other, respectively, and the rings (60 and 61) are inserted in the grooves (54 and 56), and rings (62 and 63) in grooves (55 and 57), and the ring (64) is inserted in the groove (58), and the ring (65) in the groove (59).

The telescopic actuator as per the fourth example of its embodiment, shown in FIG. 19 and FIGS. 4, 5 and FIGS. 7-13, is made up of the same elements as the actuator as per the first example of its embodiment, shown in FIGS. 1-2 and FIGS. 4-13, but it has only one expandable (moving out/sliding out) cylindrical piston (3) installed in the bushing body (1).

In all the examples of embodiment of the telescopic actuators, each internal cylindrical piston (3) or (2) has a plugged end located on the side near the head (5), with a plug (66) inserted in them, and the head (5) on its perimeter has an opening (29) for the electric wires to be inserted to control the function of the gas generator(s) (9) and of the controller (10).

In all the examples of embodiment of the actuator the head (5) with the control segment controller (10) with one or more gas generator(s) (9) can be installed. The controller (10) provides current parameters of the actuator and sends a signal to the devices controlling the actuator's function, in .order to change the pressure supplied, by sequential activation of the gas generators (9).

If the actuator has a long stand-by time before it is activated, for example in devices in which it is awaiting emergency situations, then, with its pistons collapsed (not-expanded) and held within, the inside of the actuator is protected from soiling and moisture by a seal (46) tight-sealing the bushing body (1) on its circumference at its upper end face.

Also in all the telescopic embodiments, both the sleeve body (1) and the cylindrical pistons (2 and 3) have been manufactured of cylindrical tubes of high dimensional precision of their nominal inner and outer diameters and having minimal deviations from their cylindrical shape and low surface roughness. It was the high dimensional precision of the tubes that made it possible to manufacture the sleeve/bushing body (1) and the cylindrical pistons (2 and 3) installed in it and to ensure the sliding and abrasive properties of the working surfaces and easy sealing and guiding by the use of well-selected dimensions of grooves and mating rings/rings sets (rings assemblies). In the event of wider grooves there is also a possibility of alternative use of a single wider ring or a set of narrower rings of varying properties.

The actuator as per the invention can be applied for moving/shifting elements of devices, including the elements of vehicles, especially in cases of emergency, for example to open the jammed vehicle doors, damaged safety doors/hatches or emergency exits in buildings. The actuator can also be used in devices in which there is a limited area for its installation as it has a compact configuration when its pistons are collapsed (not expanded).

The invention claimed is:

1. A telescopic actuator with tubular cylinders at the same time functioning as pistons, used to move elements of devices, especially while emergency opening damaged movable elements, characterized in that the telescopic actuator comprises a sleeve body (1), on its free end, connected with a head (5) having a controller (10) and systems feeding the actuator with pressure agent, created in the form of at least one gas generator (9), providing the pressure agent; and by the fact that the sleeve body (1), a first cylindrical piston (2) and a cylindrical piston (3) have at least one ring groove (35), (37), (39), (41) situated on the surface mating with another tubular element near the head faces of those tubular elements, in which groove(s) at least one of the rings (36), (38), (40), (42) is or at least one set of rings (47), (48), (49) is located, the set being composed of at least two rings which function as a guide and a seal for those tubular elements, the function being performed by the rings' circumference and the function of restricting resistance performed by the end faces of the rings, and those functions can be separated and distributed among the separate rings or sets of rings following one another, or the functions can be integrated in a single ring and the sealing function and the guiding function is performed by cooperation of single rings or sets of rings with the tubular elements of the body (1), the first piston (2) and the second piston (3), as cylindrical tubes of high dimensional precision and high cylindrical shape precision of their inner and outer diameters and low surface roughness, wherein the controller (10) and the at least one gas generator (9) are located in the head (5) securing ring (27) graduated openings (8) of a plate (7) set in this head (5) and the controller (10) and the at least one gas generator (9) are secured with a pressing plate (11) and secured with a safety ring (27), and an opening (29) in the head's wall (5) formed in the head (5) for electric wires to be inserted therein, and wherein the gas generator (9) or the controller (10) or the pressing plate are secured with the safety ring (27).

2. The telescopic actuator according to claim 1, further characterized in that the controller (10) controls at least the pressure, the stroke or the pressure and the stroke of the actuator and transmitting a signal to activating elements controlling and changing the actuator's pressure value.

3. The telescopic actuator according to claim 1, further characterized in that the telescopic actuator comprises a support sleeve (34) located on the outer wall of the body (1).

4. The telescopic actuator according to claim 1, further characterized in that a second resistance surface of the actuator is that of a pressing element (4) with a cylindrical, retaining protruding element (45) and with a sealing ring (46) adjacent to an outer surface of the sleeve body (1) in the status of cylinders being inside the actuator.

5. The telescopic actuator according to claim 2, further characterized in that with the pre determined dimensional parameters of its tubes, the slide parameters of the actuator are determined by the dimensions of the ring grooves (35), (37), (39), (41), (50), (51), (54), (55), (56), (57), 58), (59) and by the shape or the set of the rings located in the grooves.

6. The telescopic actuator according to claim 1, further comprising wherein the first cylindrical piston (2) is able to move inside the sleeve body (1).

7. A telescopic actuator for displacing movable objects, especially in emergency, comprising a set of coaxial cylindrical sleeves consisting of at least an outer cylindrical sleeve (1), and an inner cylindrical sleeve (3), with at least one annular groove (35, 37, 39, 41, 50, 51, 54-59) shaped on proximal or distal ends of surfaces of cylindrical sleeves that face a second surface of the cylindrical sleeves, and comprising at least one annular ring (36, 38, 40, 42, 52, 53, 60-65) placed in the respective annular groove (35, 37, 39, 41, 50, 51, 54-59), characterized in that the actuator comprises a head (5) equipped with a proximal tubular part containing a first fixing plate (7) shaped with graded openings (8), a second fixing plate (11) shaped with cylindrical openings (12), at least one gas generator (9), and at least one controller (10), wherein the at least one gas generator (9) is placed laterally, and at least one controller (10) is placed centrally in both the graded openings (8) in the first fixing plate (7), and in the cylindrical openings (12) in the second fixing plate (11), the second fixing plate being sealed in the tubular part of the head (5) with a sealing ring (25) placed in a sealing groove (26), and retained with a retaining ring (27) placed in a retaining groove (28), wherein the outer cylindrical sleeve (1), at the proximal end, is connected to the head (5).

8. The actuator according to claim 7, characterized in that the tubular part of the head (5) is closed with a cap (6) fixed with a cap sealing ring (29) inserted in a cap sealing groove (30).

9. The actuator according to claim 7, characterized in that the controller (10) comprises or is connected to a pressure sensor or a pressure stroke sensor, or an actuator stroke sensor or travel sensor, and in that the controller (10) comprises or is connected to the actuator for actuating the at least one gas generator (9).

10. The actuator according to claim 7, characterized in that the outer cylindrical sleeve (1) has an annular stop groove (32) on an external surface at the distal end with a stop ring (33) securing a stop bushing (34).

11. The actuator according to claim 7, characterized in that the distal end of the inner cylindrical sleeve (3) is closed with a pressing element (4) shaped at proximal side with a cylindrical protrusion (45) matching the internal cross section of the inner cylindrical sleeve (3) at the distal end, and with a ring (46) matching the external cross section of the outer cylindrical sleeve (1) at the distal end.

12. The actuator according to claim 7, characterized in that the cylindrical protrusion (45) of the pressing element (4) is fixed in the inner cylindrical sleeve (3) with an annular ring (44) inserted in an annular groove (43).

13. The actuator according to claim 7, characterized in that the set of coaxial cylindrical sleeves consists of exactly two sleeves: the outer cylindrical sleeve (1), and the inner cylindrical sleeve (3) with the external diameter smaller than the internal diameter of the outer cylindrical sleeve (1).

14. The actuator according to claim 7, characterized in that the set of coaxial cylindrical sleeves consists of exactly three sleeves: the outer cylindrical sleeve (1), a middle cylindrical sleeve (2) with the external diameter smaller than the internal diameter of the outer cylindrical sleeve (1), and the inner cylindrical sleeve (3) with the external diameter smaller than the internal diameter of the middle cylindrical sleeve (2).

15. The actuator according to claim 7, characterized in that between the external surface of the proximal end of the outer cylindrical sleeve (1) and the or external surface of the distal end of the head (5) of the actuator is equipped with a distal sealing ring (16) placed in a distal sealing groove (18) shaped in the outer cylindrical sleeve (1), and a proximal sealing ring (17) placed in a proximal sealing groove (19) shaped in the head (5), wherein a protective ring (13) is placed between the distal sealing ring (16) and the proximal sealing ring (17) in a first protective groove (14) shaped in the outer cylindrical sleeve (1) and in a second protective groove (15) shaped in the head (5), and in that the first protective groove (14) and the second protective groove (15) face each other.

16. The actuator according to claim 7, characterized in that the head (5) has, at the proximal end, a port for electric wires to connect at least one gas generator (9) and the controller (10) to external devices.

17. The actuator according to claim 7, characterized in that the inner cylindrical sleeve (3) is plugged at the proximal end with a plug (66).

18. The actuator according to claim 7, characterized in that the actuator is equipped with at least one pair of guiding and sealing annular rings (47, 48, 49) inserted in the annular grooves (35, 37, 39, 41).

19. The actuator according to claim 7 further comprising a middle cylindrical sleeve (2) having a first end and a second end;

wherein the inner cylindrical sleeve (3) has a first end and a second end;

wherein the first end of the inner cylindrical sleeve (3) is on the same side as the first end of the middle cylindrical sleeve (2);

a first annular groove (54) located at the first end of the inner cylindrical sleeve (3);

a second annular groove (55) located at the first end of the inner cylindrical sleeve (3) and next to the first annular groove;

a third annular groove (56) located at the first end of the middle cylindrical sleeve (2);

a fourth annular groove (57) located at the first end of the middle cylindrical sleeve (2) and next to the third annular groove;

a fifth annular groove (58) located at the second end of the middle cylindrical sleeve (2);

a sixth annular groove (59) located at the second end of the middle cylindrical sleeve (2) and next to the fifth annular groove;

a first annular ring (60) inserted in the first annular groove (54);

a second annular ring (61) inserted in the second annular groove (55);

a third annular ring (62) inserted in the third annular groove (56);

a fourth annular ring 63) inserted in the fourth annular groove (57);

a fifth annular ring (64) inserted in the fifth annular groove (58), and a sixth annular ring (65) inserted in the sixth annular groove (59).

20. A telescopic actuator for displacing mobile objects comprising a bushing (1);

a first cylindrical piston (2);

a second cylindrical piston (3);

a pressing element (4) covering one end face of the first cylindrical piston (2) and one end face of the second cylindrical piston and one end face of the bushing;

a head (5) fitted on the other end of the bushing (1);

a plug (6) covering the outer end face of the head (5);

a round plate (7) fitted in the head (5);

graduated openings (8) disposed in the plate (7);

gas generators (9) fixed in the graduated openings (8) in the plate (7);

a pressure controller (10) installed between the graduated openings (8);

and a retaining plate (11) with round openings (12) present in the retaining plate (11).

* * * * *